US011732734B2

(12) United States Patent
Huang

(10) Patent No.: US 11,732,734 B2
(45) Date of Patent: Aug. 22, 2023

(54) HYDRAULIC CONTROL SYSTEM

(71) Applicants: HAWE Hydraulik (Wuxi) Co., Ltd., Wuxi (CN); HAWE Hydraulik SE, Aschheim (DE)

(72) Inventor: Changfa Huang, Wuxi (CN)

(73) Assignees: HAWE HYDRAULIK (WUXI) CO., LTD., Wuxi (CN); HAWE HYDRAULIK SE, Aschheim (DE)

( * ) Notice: Subject to any disclaimer, the term of this patent is extended or adjusted under 35 U.S.C. 154(b) by 0 days.

(21) Appl. No.: 17/731,531

(22) Filed: Apr. 28, 2022

(65) Prior Publication Data

US 2022/0364578 A1 Nov. 17, 2022

(30) Foreign Application Priority Data

May 12, 2021 (CN) ..... 202110518660.9

(51) Int. Cl.
*F15B 13/08* (2006.01)
*F15B 13/02* (2006.01)

(52) U.S. Cl.
CPC ..... *F15B 13/0807* (2013.01); *F15B 13/027* (2013.01); *F15B 13/086* (2013.01); *F15B 13/0857* (2013.01); *F15B 2211/3056* (2013.01); *F15B 2211/30505* (2013.01); *F15B 2211/526* (2013.01)

(58) Field of Classification Search
CPC ..... F15B 13/0807; F15B 13/027; F15B 13/0857; F15B 13/086; F15B 2211/30505; F15B 2211/3056; F15B 2211/526
USPC .... 137/884; 91/45, 489, 490, 492, 178, 526, 91/418
See application file for complete search history.

(56) References Cited

U.S. PATENT DOCUMENTS 3,502,002 A * 3/1970 Whiteman, Jr. ..... F04B 9/1178 91/402
3,851,566 A * 12/1974 Herrmann ..... F15B 11/16 91/526

(Continued)

FOREIGN PATENT DOCUMENTS

DE 102005029822 A1 10/2006
JP 56015947 A1 2/1981

(Continued)

OTHER PUBLICATIONS

Japanese Office Action Notification of reasons for refusal dated Mar. 30, 2023; Patent Application 2022-057047.

*Primary Examiner* — Minh Q Le
(74) *Attorney, Agent, or Firm* — Dinsmore & Shohl LLP

(57) ABSTRACT

A hydraulic control system includes a first hydraulic cylinder, a second hydraulic cylinder, a fluid supply apparatus, a first control valve bank, a second control valve bank, a third control valve bank, and a first check valve. The first control valve bank is configured to independently control the first hydraulic cylinder; the second control valve bank is configured to independently control the second hydraulic cylinder; and the third control valve bank is configured to synchronously control the first hydraulic cylinder and the second hydraulic cylinder. Synchronous volume control is implemented through series connection of the hydraulic cylinders, and has quite high synchronization precision, which is measured to be up to two percent.

10 Claims, 7 Drawing Sheets

(56) References Cited

U.S. PATENT DOCUMENTS 3,916,624 A * 11/1975 Machens ..... E02F 9/0841 60/486
3,921,479 A * 11/1975 Katz ..... B23Q 15/013 82/134
3,990,594 A * 11/1976 Olson ..... B66F 9/183 91/531
4,165,674 A * 8/1979 Weigt ..... F15B 21/08 91/511
4,341,149 A * 7/1982 Dezelan ..... F15B 11/003 172/260.5
4,500,250 A * 2/1985 Maurer ..... E02F 3/384 91/185
5,083,430 A * 1/1992 Hirata ..... F15B 13/0417 91/531
6,571,679 B2 * 6/2003 Atkinson ..... B27L 7/00 91/520
10,889,965 B2 * 1/2021 Richards ..... E02F 9/2285
2002/0070071 A1 * 6/2002 Schuh ..... B62D 5/065 180/408
2005/0044849 A1 * 3/2005 Berthod ..... F15B 11/003 60/468
2005/0072145 A1 * 4/2005 Jervis ..... E02F 9/2239 60/430
2006/0099081 A1 * 5/2006 Toda ..... E02F 9/2235 417/1
2014/0283676 A1 * 9/2014 Beschorner ..... E02F 9/2292 91/418
2015/0361995 A1 * 12/2015 Joung ..... E02F 9/2228 60/413
2021/0025129 A1 * 1/2021 Kenkel ..... F15B 21/047

FOREIGN PATENT DOCUMENTS

JP 02-096028 A2 4/1990
WO 2016061797 A1 4/2016

* cited by examiner

HYDRAULIC CONTROL SYSTEM

CROSS-REFERENCE TO RELATED APPLICATIONS

This application claims priority to China application number 202110518660.9 filed May 12, 2021, the disclosure of which is hereby incorporated by reference in its entirety.

FIELD OF THE INVENTION

The present invention relates to hydraulic control technologies, and in particular, to a hydraulic control system.

BACKGROUND OF THE INVENTION

Generally, an hydraulic control apparatus or device is applied to synchronous control and independent operation of two actuators.

Conventional synchronous control methods include mechanical synchronization of an independent torsion beam structure, synchronization of convergence and collection control, synchronization of a motor, volume synchronization of series hydraulic cylinders, closed-loop synchronization of electrical rate control, and the like. The foregoing synchronous control principle cannot meet the requirement for independent operation except the rate control. However, the rate control is relatively high in costs.

The present invention provides a hydraulic system, which can resolve the problem that currently two actuators need to independently act to adjust an angle or a position relationship and further need to synchronously act in the case of the adjusted relative angle or position relationship.

SUMMARY OF THE INVENTION

According to an aspect of the present invention, a hydraulic control system is provided, including a first hydraulic cylinder, a second hydraulic cylinder, and an fluid supply apparatus, where the fluid supply apparatus is provided with a fluid conveying port and a fluid returning port, and the hydraulic control system further includes: a first control valve bank, where the first hydraulic cylinder is connected to the fluid conveying port and the fluid returning port by using the first control valve bank, and the first control valve bank is configured to independently control the first hydraulic cylinder; a second control valve bank, where the second hydraulic cylinder is connected to the fluid conveying port and the fluid returning port by using the second control valve bank, and the second control valve bank is configured to independently control the second hydraulic cylinder; a third control valve bank, where one port of the first hydraulic cylinder and one port of the second hydraulic cylinder are connected in series, the other port of the first hydraulic cylinder and the other port of the second hydraulic cylinder are connected to the fluid conveying port and the fluid returning port by using the third control valve bank respectively, and the third control valve bank is configured to synchronously control the first hydraulic cylinder and the second hydraulic cylinder; and a first check valve, where the first check valve is disposed on a series-connection fluid path of the first hydraulic cylinder and the second hydraulic cylinder, and a sensing connection of the first check valve is connected to the third control valve bank.

The hydraulic control system provided in the present invention can independently or synchronously control the first hydraulic cylinder and the second hydraulic cylinder.

The first control valve bank controls telescopic action of the first hydraulic cylinder, the second control valve bank controls telescopic action of the second hydraulic cylinder, and the third control valve bank controls synchronous telescopic action of the first hydraulic cylinder and the second hydraulic cylinder. In synchronous control, the first hydraulic cylinder, the second hydraulic cylinder, the third control valve bank, and the fluid supply apparatus are connected in series. Synchronous volume control is implemented through series connection of the hydraulic cylinders, and has quite high synchronization precision, which is measured to be up to two percent. The present invention differs from the prior art mainly in that a function of combining independent action with synchronous action is implemented. Compared with the prior art in which synchronous action hydraulic cylinders can only operate synchronously and independent action hydraulic cylinders can only act independently, the present invention differs mainly in that two hydraulic cylinders are used for independent action without requiring two actuation hydraulic cylinders for synchronization.

In some embodiments, the third control valve bank includes a first solenoid valve and a second solenoid valve, where a first port of the first solenoid valve and a first port of the second solenoid valve are both connected to the fluid conveying port, a second port of the first solenoid valve and a second port of the second solenoid valve are both connected to the fluid returning port, a third port of the first solenoid valve is connected to an port of the first hydraulic cylinder, and a third port of the second solenoid valve is connected to an port of the second hydraulic cylinder.

Therefore, synchronous telescopic action of the first hydraulic cylinder and the second hydraulic cylinder is controlled by controlling the first solenoid valve and the second solenoid valve. When the first solenoid valve is energized, the first hydraulic cylinder and the second hydraulic cylinder retract synchronously. When the second solenoid valve is energized, the first hydraulic cylinder and the second hydraulic cylinder extend synchronously.

In some embodiments, the third control valve bank further includes a second check valve and a third check valve, where the third port of the first solenoid valve is connected to one port of the first hydraulic cylinder by using the second check valve, and the third port of the second solenoid valve is connected to one port of the second hydraulic cylinder by using the third check valve; a sensing connection of the second check valve is connected between the second solenoid valve and the third check valve, and a sensing connection of the third check valve is connected between the first solenoid valve and the second check valve.

Therefore, the second check valve and the third check valve ensure stable supply by a system fluid path.

In some embodiments, the first control valve bank includes a third solenoid valve and a fourth solenoid valve, where a first port of the third solenoid valve and a first port of the fourth solenoid valve are both connected to the fluid conveying port, a second port of the third solenoid valve and a second port of the fourth solenoid valve are both connected to the fluid returning port, a third port of the third solenoid valve is connected to one port of the first hydraulic cylinder, and a third port of the fourth solenoid valve is connected to the other port of the first hydraulic cylinder.

Therefore, independent telescopic action of the first hydraulic cylinder is controlled by controlling the third solenoid valve and the fourth solenoid valve. When the third solenoid valve is energized, the first hydraulic cylinder retracts. When the fourth solenoid valve is energized, the first hydraulic cylinder extends.

In some embodiments, the first control valve bank further includes a fourth check valve and a fifth check valve, where the third port of the third solenoid valve is connected to one port of the first hydraulic cylinder by using the fourth check valve, and the third port of the fourth solenoid valve is connected to the other port of the first hydraulic cylinder by using the fifth check valve; a sensing connection of the fourth check valve is connected between the fourth solenoid valve and the fifth check valve, and a sensing connection of the fifth check valve is connected between the third solenoid valve and the fourth check valve.

Therefore, the fourth check valve and the fifth check valve ensure stable supply by a system fluid path.

In some implementations, the third port of the first solenoid valve is connected to one port of the first hydraulic cylinder by converging between the third solenoid valve and the first hydraulic cylinder; and the second port of the first solenoid valve is connected to the fluid returning port by converging between the third solenoid valve and the fluid returning port.

Therefore, an fluid path layout is simplified, a pipeline length is reduced, and costs are reduced.

In some embodiments, the second control valve bank includes a fifth solenoid valve and a sixth solenoid valve, where a first port of the fifth solenoid valve and a first port of the sixth solenoid valve are both connected to the fluid conveying port, a second port of the fifth solenoid valve and a second port of the sixth solenoid valve are both connected to the fluid returning port, a third port of the fifth solenoid valve is connected to one port of the second hydraulic cylinder, and a third port of the sixth solenoid valve is connected to the other port of the second hydraulic cylinder.

Therefore, independent telescopic action of the second hydraulic cylinder is controlled by controlling the fifth solenoid valve and the sixth solenoid valve. When the fifth solenoid valve is energized, the second hydraulic cylinder retracts. When the sixth solenoid valve is energized, the second hydraulic cylinder extends.

In some embodiments, the second control valve bank further includes a sixth check valve and a seventh check valve, where the third port of the fifth solenoid valve is connected to one port of the second hydraulic cylinder by using the sixth check valve, and the third port of the sixth solenoid valve is connected to the other port of the second hydraulic cylinder by using the fifth check valve; a sensing connection of the sixth check valve is connected between the sixth solenoid valve and the seventh check valve, and a sensing connection of the seventh check valve is connected between the fifth solenoid valve and the sixth check valve.

Therefore, the sixth check valve and the seventh check valve ensure stable supply by a system fluid path.

In some embodiments, the third port of the second solenoid valve is connected to one port of the second hydraulic cylinder by converging between the sixth solenoid valve and the second hydraulic cylinder; and the second port of the second solenoid valve is connected to the fluid returning port by converging between the sixth solenoid valve and the fluid returning port.

Therefore, an fluid path layout is simplified, a pipeline length is reduced, and costs are reduced.

In some embodiments, connections that connect the first control valve bank, the second control valve bank and the third control valve bank to the fluid returning port are each provided with a throttle valve.

Therefore, the throttle valves control the flow speed of fluid in the system, so as to control the speed of telescopic action of the first hydraulic cylinder and the second hydraulic cylinder.

The present invention has the beneficial effects, that (1) synchronous volume control is implemented through series connection of the hydraulic cylinders, and has quite high synchronization precision, which is measured to be up to two percent;

(2) no servo controller or control valve of an external electric appliance is provided, bringing a great cost advantage;

(3) the system has a strong pollutant-holding capacity and is not sensitive to temperature variations, a requirement for fluid contamination control of the system is low, and synchronization precision is not affected by a temperature difference;

(4) biased load resistance is strong, and high-precision synchronization can still be implemented when 100% extreme biased load acts on one hydraulic cylinder;

(5) the system is applicable to an occasion in which independent operate and synchronous operation are both needed; and (6) the system is simple in structure and low in cost.

DESCRIPTION OF THE INVENTION

The following further describes the present invention in detail with reference to the accompanying drawings.

Figure 1:
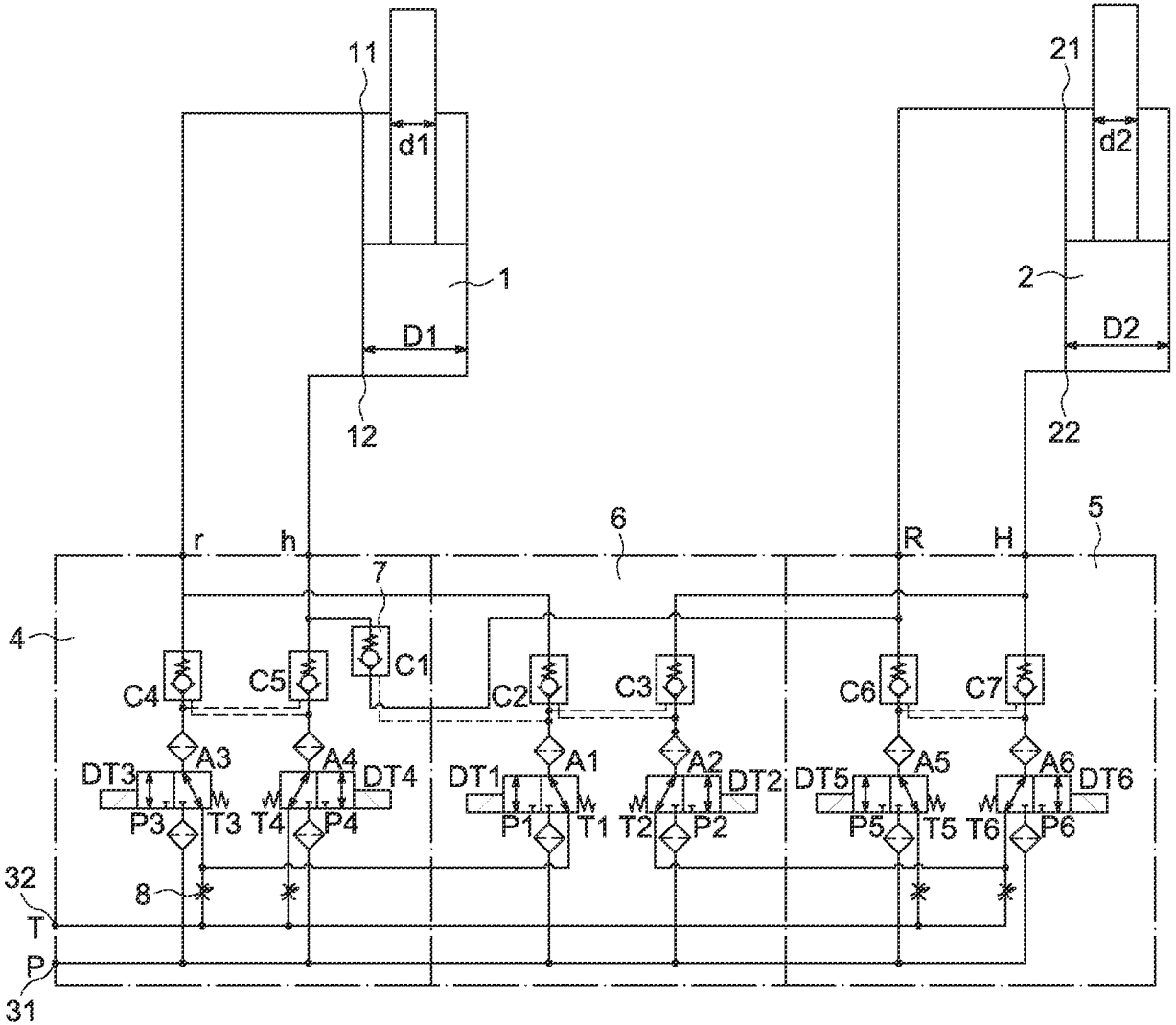
FIG. 1 is a schematic diagram of an fluid path structure of a hydraulic control system according to an implementation of the present invention.

FIG. 1 shows an example of a hydraulic control system according to an implementation of the present invention. The hydraulic control system includes a first hydraulic cylinder 1, a second hydraulic cylinder 2, and an fluid supply apparatus, where the fluid supply apparatus is provided with a fluid conveying port 31 and a fluid returning port 32, and the fluid conveying port 31 and the fluid returning port 32 are marked as P and T respectively. The first hydraulic cylinder 1 is provided with a first fluid port 11 and a second fluid port 12. The second hydraulic cylinder 2 is provided with a third fluid port 21 and a fourth fluid port 22. The hydraulic control system further includes:

a first control valve bank 4, where the first hydraulic cylinder 1 is connected to the fluid conveying port 31 and the fluid returning port 32 by using the first control valve bank 4, and the first control valve bank 4 is configured to independently control the first hydraulic cylinder 1;

a second control valve bank 5, where the second hydraulic cylinder 2 is connected to the fluid conveying port 31 and the fluid returning port 32 by using the second control valve bank 5, and the second control valve bank 5 is configured to independently control the second hydraulic cylinder 2;

a third control valve bank 6, where one port of the first hydraulic cylinder 1 and one port of the second hydraulic cylinder 2 are connected in series, and the second fluid port 12 of the first hydraulic cylinder 1 is connected to the third fluid port 21 of the second hydraulic cylinder 2; the other port of the first hydraulic cylinder 1 and the other port of the second hydraulic cylinder 2 are connected to the fluid conveying port 31 and the fluid returning port 32 by using the third control valve bank 6 respectively, the first fluid port 11 of the first hydraulic cylinder 1 is connected to the fourth fluid port 22 of the second hydraulic cylinder 2 by using the third control valve bank 6, and the third control valve bank 6 is connected to the fluid conveying port 31 and the fluid returning port 32; and the third control valve bank 6 is configured to synchronously control the first hydraulic cylinder 1 and the second hydraulic cylinder 2; and a first check valve 7, where the first check valve 7 is disposed on a series-connection fluid path of the first hydraulic cylinder 1 and the second hydraulic cylinder 2, and a sensing connection of the first check valve 7 is connected to the third control valve bank 6.

The hydraulic control system provided in the present invention can independently or synchronously control the first hydraulic cylinder 1 and the second hydraulic cylinder 2. The first control valve bank 4 controls telescopic action of the first hydraulic cylinder 1, the second control valve bank 5 controls telescopic action of the second hydraulic cylinder 2, and the third control valve bank 6 controls synchronous telescopic action of the first hydraulic cylinder 1 and the second hydraulic cylinder 2. In synchronous control, the first hydraulic cylinder 1, the second hydraulic cylinder 2, the third control valve bank 6, and the fluid supply apparatus are connected in series. Synchronous volume control is implemented through series connection of the hydraulic cylinders, and has quite high synchronization precision, which is measured to be up to two percent. The present invention differs from the prior art mainly in that a function of combining independent action with synchronous action is implemented. Compared with the prior art in which synchronous action hydraulic cylinders can only operate synchronously and independent action hydraulic cylinders can only act independently, the present invention differs mainly in that two hydraulic cylinders are used for independent action without requiring two actuation hydraulic cylinders for synchronization.

Figure 6:
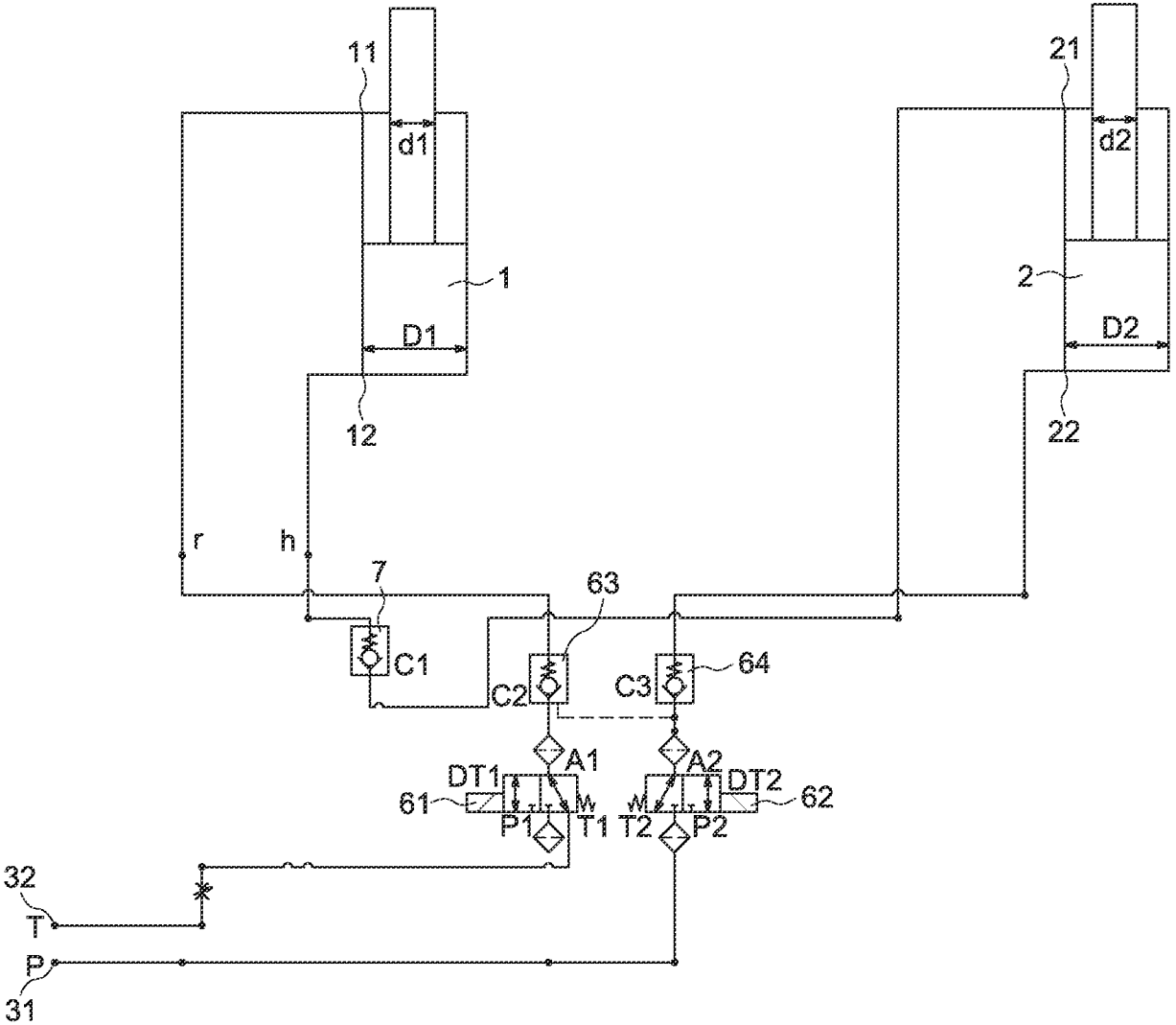
FIG. 6 is a schematic diagram of an fluid path structure in which the first hydraulic cylinder and the second hydraulic cylinder in the hydraulic control system shown in FIG. 1 are synchronously controlled.
Figure 7:
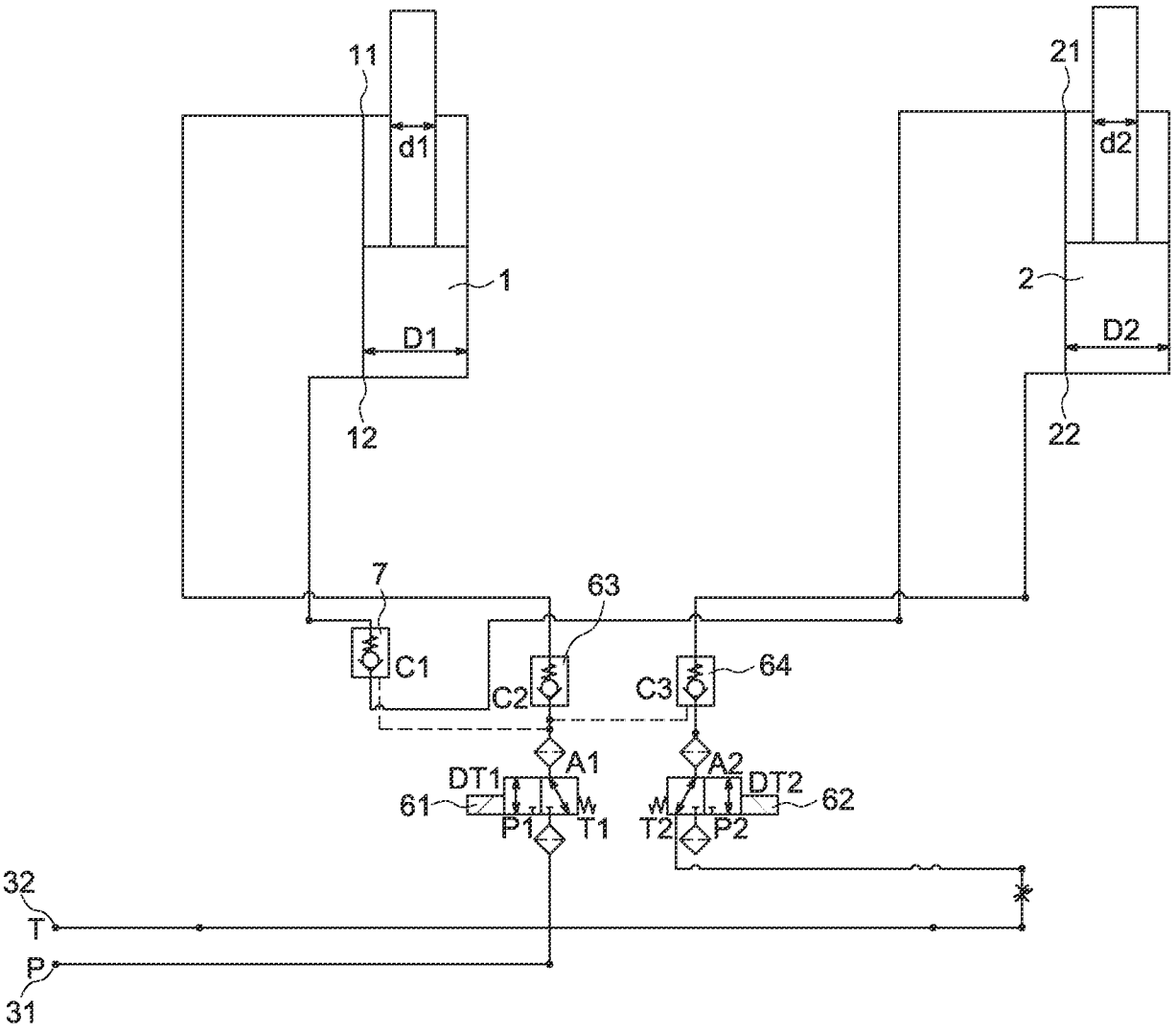
FIG. 7 is a schematic diagram of another fluid path structure in which the first hydraulic cylinder and the second hydraulic cylinder in the hydraulic control system shown in FIG. 1 are synchronously controlled.

With reference to FIG. 1, FIG. 6, and FIG. 7, the third control valve bank 6 includes a first solenoid valve 61 and a second solenoid valve 62. The first solenoid valve 61 and the second solenoid valve 62 are each a two-position three-way solenoid directional valve. Therefore, the first solenoid valve 61 and the second solenoid valve 62 are each provided with a first port, a second port, and a third port, where the first port, the second port, and the third port of the first solenoid valve 61 are marked as P1, T1, and A1 respectively; and the first port, the second port, and the third port of the second solenoid valve 62 are marked as P2, T2, and A2 respectively.

The first port of the first solenoid valve 61 and the first port of the second solenoid valve 62 are both connected to the fluid conveying port 31, the second port of the first solenoid valve 61 and the second port of the second solenoid valve 62 are both connected to the fluid returning port 32, the third port of the first solenoid valve 61 is connected to the first fluid port 11 of the first hydraulic cylinder 1, and the third port of the second solenoid valve 62 is connected to the fourth fluid port 22 of the second hydraulic cylinder 2. Synchronous telescopic action of the first hydraulic cylinder 1 and the second hydraulic cylinder 2 is controlled by controlling the first solenoid valve 61 and the second solenoid valve 62. When the first solenoid valve 61 is energized, the first hydraulic cylinder 1 and the second hydraulic cylinder 2 retract synchronously. When the second solenoid valve 62 is energized, the first hydraulic cylinder 1 and the second hydraulic cylinder 2 extend synchronously.

With reference to FIG. 1, FIG. 6 and FIG. 7, the third control valve bank 6 further includes a second check valve 63 and a third check valve 64, where the third port of the first solenoid valve 61 is connected to the first fluid port 11 of the first hydraulic cylinder 1 by using the second check valve 63, and the third port of the second solenoid valve 62 is connected to the fourth fluid port 22 of the second hydraulic cylinder 2 by using the third check valve 64; a sensing connection of the second check valve 63 is connected between the second solenoid valve 62 and the third check valve 64, and a sensing connection of the third check valve 64 is connected between the first solenoid valve 61 and the second check valve 63. The second check valve 63 and the third check valve 64 ensure stable supply by a system fluid path. A sensing connection of the first check valve 7 is connected to a pipeline between the first solenoid valve 61 and the second check valve 63 in the third control valve bank 6.

Figure 2:
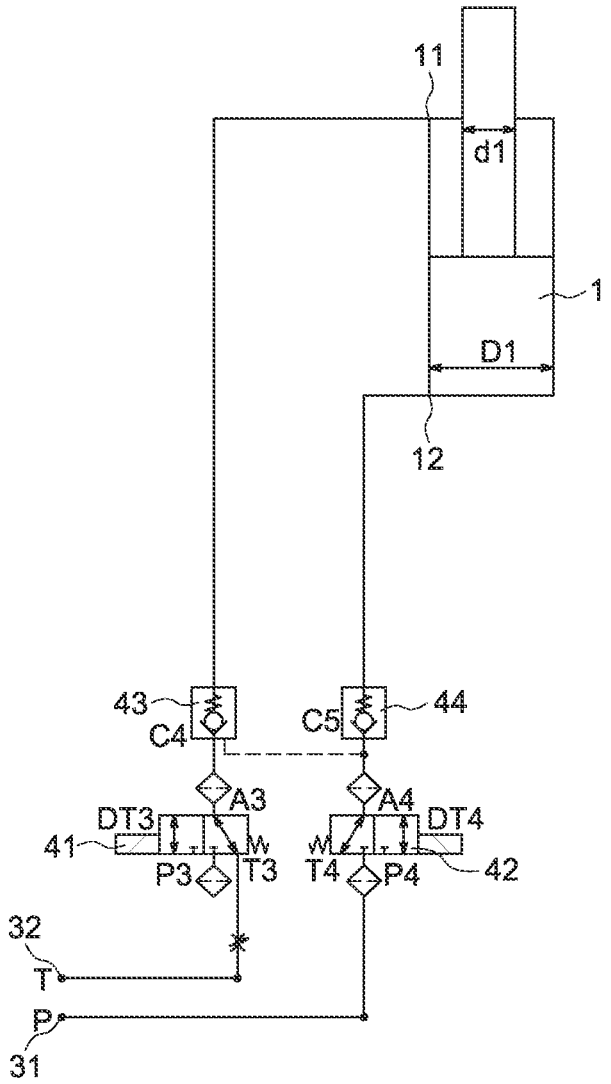
FIG. 2 is a schematic diagram of an fluid path structure in which a first hydraulic cylinder in the hydraulic control system shown in FIG. 1 is independently controlled.
Figure 3:
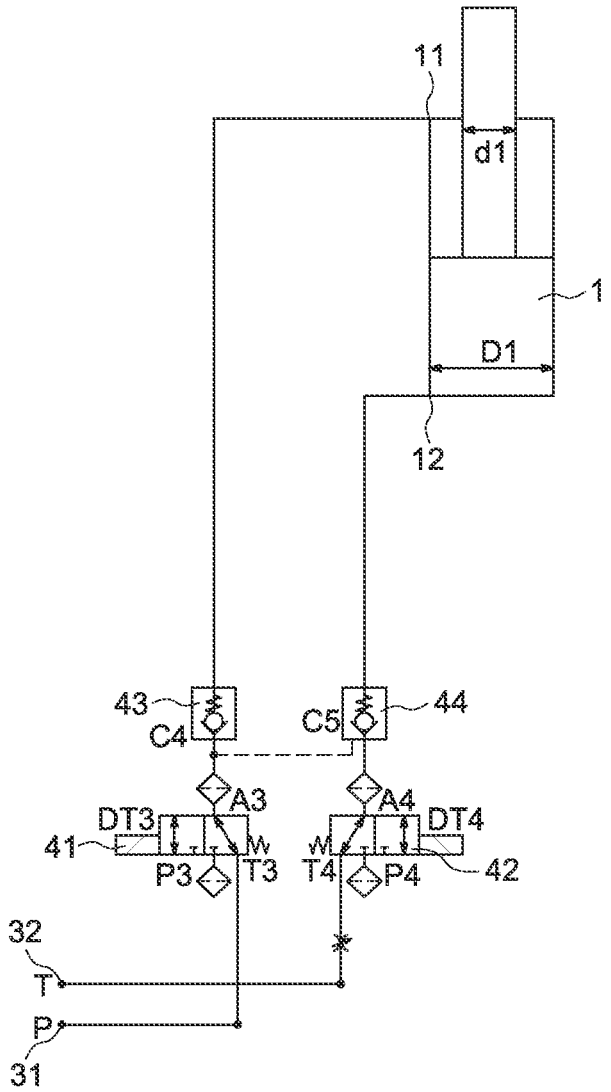
FIG. 3 is a schematic diagram of another fluid path structure in which the first hydraulic cylinder in the hydraulic control system shown in FIG. 1 is independently controlled.

With reference to FIG. 1 to FIG. 3, the first control valve bank 4 includes a third solenoid valve 41 and a fourth solenoid valve 42. The third solenoid valve 41 and the fourth solenoid valve 42 are each a two-position three-way solenoid directional valve. Therefore, the third solenoid valve 41 and the fourth solenoid valve 42 are each provided with a first port, a second port, and a third port, where the first port, the second port, and the third port of the third solenoid valve 41 are marked as P3, T3, and A3 respectively; and the first port, the second port, and the third port of the fourth solenoid valve 42 are marked as P4, T4, and A4 respectively.

The first port of the third solenoid valve 41 and the first port of the fourth solenoid valve 42 are both connected to the fluid conveying port 31, the second port of the third solenoid valve 41 and the second port of the fourth solenoid valve 42 are both connected to the fluid returning port 32, the third port of the third solenoid valve 41 is connected to the first fluid port 11 of the first hydraulic cylinder 1, and the third port of the fourth solenoid valve 42 is connected to the second fluid port 12 of the first hydraulic cylinder 1. Independent telescopic action of the first hydraulic cylinder 1 is controlled by controlling the third solenoid valve 41 and the fourth solenoid valve 42. When the third solenoid valve 41 is energized, the first hydraulic cylinder 1 retracts. When the fourth solenoid valve 42 is energized, the first hydraulic cylinder 1 extends.

With reference to FIG. 1 to FIG. 3, the first control valve bank 4 further includes a fourth check valve 43 and a fifth check valve 44, where the third port of the third solenoid valve 41 is connected to the first fluid port 11 of the first hydraulic cylinder 1 by using the fourth check valve 43, and the third port of the fourth solenoid valve 42 is connected to the second fluid port of the first hydraulic cylinder 1 by using the fifth check valve 44; a sensing connection of the fourth check valve 43 is connected to a pipeline between the fourth solenoid valve 42 and the fifth check valve 44, and a sensing connection of the fifth check valve 44 is connected to a pipeline between the third solenoid valve 41 and the fourth check valve 43. The fourth check valve 43 and the fifth check valve 44 ensure stable supply by a system fluid path.

With reference to FIG. 1, the third port of the first solenoid valve 61 is connected to one port of the first hydraulic cylinder 1 by converging between the third solenoid valve 41 and the first hydraulic cylinder 1; and the second port of the first solenoid valve 61 is connected to the fluid returning port 32 by converging between the third solenoid valve 41 and the fluid returning port 32. An fluid path layout is simplified, a pipeline length is reduced, and costs are reduced.

Figure 4:
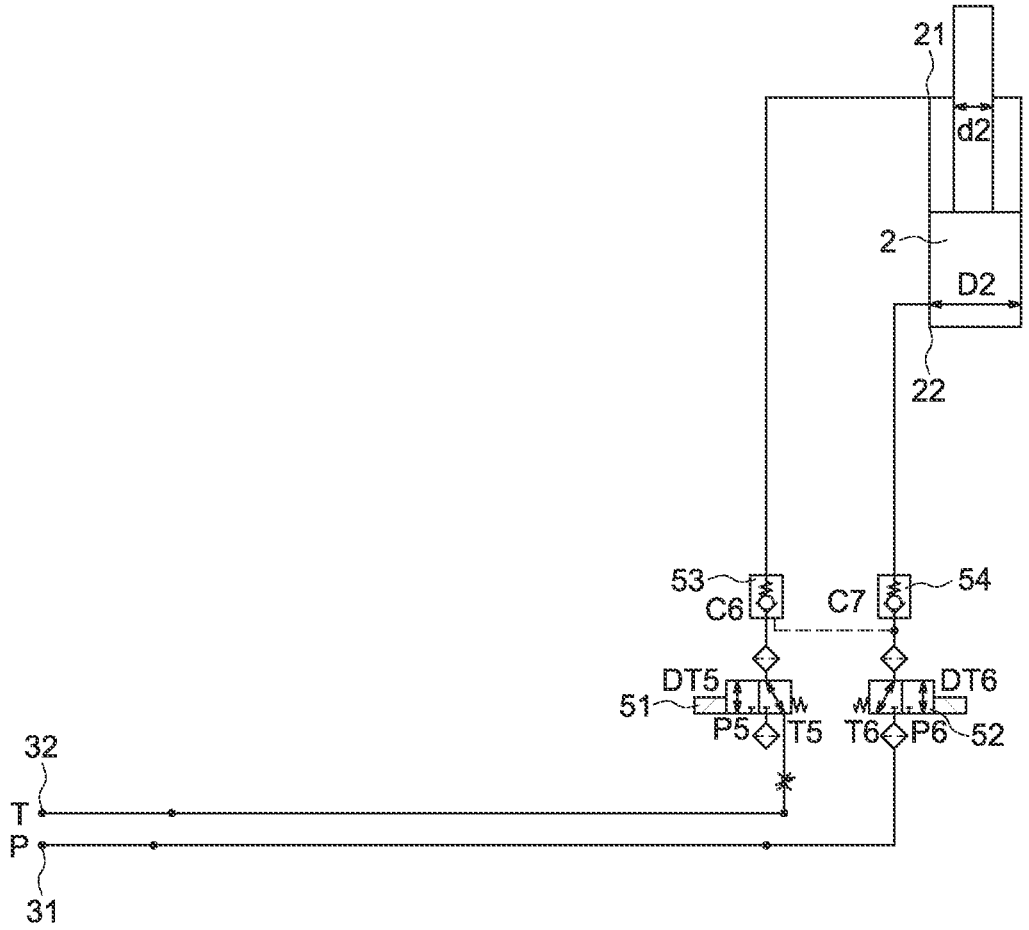
FIG. 4 is a schematic diagram of an fluid path structure in which a second hydraulic cylinder in the hydraulic control system shown in FIG. 1 is independently controlled.
Figure 5:
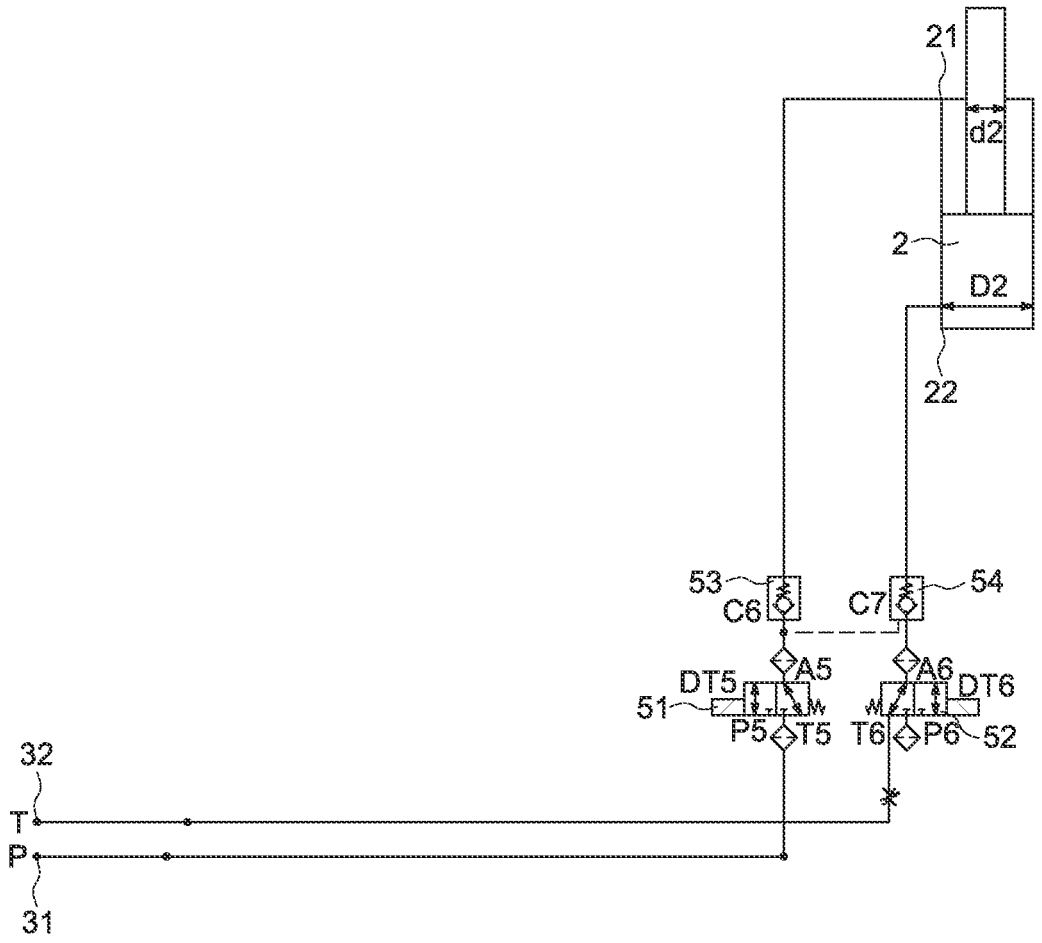
FIG. 5 is a schematic diagram of another fluid path structure in which the second hydraulic cylinder in the hydraulic control system shown in FIG. 1 is independently controlled.

With reference to FIG. 1, FIG. 4, and FIG. 5, the second control valve bank 5 includes a fifth solenoid valve 51 and a sixth solenoid valve 52. The fifth solenoid valve 51 and the sixth solenoid valve 52 are each a two-position three-way solenoid directional valve. Therefore, the fifth solenoid valve 51 and the sixth solenoid valve 52 are each provided with a first port, a second port, and a third port, where the first port, the second port, and the third port of the fifth solenoid valve are marked as P5, T5, and A5 respectively; and the first port, the second port, and the third port of the sixth solenoid valve 52 are marked as P6, T6, and A6 respectively.

The first port of the fifth solenoid valve 51 and the first port of the sixth solenoid valve 52 are both connected to the fluid conveying port 31, the second port of the fifth solenoid valve 51 and the second port of the sixth solenoid valve 52 are both connected to the fluid returning port 32, the third port of the fifth solenoid valve 51 is connected to the third fluid port 21 of the second hydraulic cylinder 2, and the third port of the sixth solenoid valve 52 is connected to the fourth fluid port 22 of the second hydraulic cylinder 2. Independent telescopic action of the second hydraulic cylinder 2 is controlled by controlling the fifth solenoid valve 51 and the sixth solenoid valve 52. When the fifth solenoid valve 51 is energized, the second hydraulic cylinder 2 retracts. When the sixth solenoid valve 52 is energized, the second hydraulic cylinder 2 extends.

With reference to FIG. 1, FIG. 4, and FIG. 5, the second control valve bank 5 further includes a sixth check valve 53 and a seventh check valve 54, where the third port of the fifth solenoid valve 51 is connected to the third fluid port 21 of the second hydraulic cylinder 2 by using the sixth check valve 53, and the third port of the sixth solenoid valve 52 is connected to the fourth fluid port 22 of the second hydraulic cylinder 2 by using the fifth check valve 44; a sensing connection of the sixth check valve 53 is connected between the sixth solenoid valve 52 and the seventh check valve 54, and a sensing connection of the seventh check valve 54 is connected between the fifth solenoid valve 51 and the sixth check valve 53. The sixth check valve 53 and the seventh check valve 54 ensure stable supply by a system fluid path.

With reference to FIG. 1, the third port of the second solenoid valve 62 is connected to one port of the second hydraulic cylinder 2 by converging between the sixth solenoid valve 52 and the second hydraulic cylinder 2; and the second port of the second solenoid valve 62 is connected to the fluid returning port 32 by converging between the sixth solenoid valve 52 and the fluid returning port 32. An fluid path layout is simplified, a pipeline length is reduced, and costs are reduced.

With reference to FIG. 1, connections that connect the first control valve bank 4, the second control valve bank 5 and the third control valve bank 6 to the fluid returning port 32 are each provided with a throttle valve 8. The throttle valves 8 control the flow speed of fluid in the system, so as to control the speed of telescopic action of the first hydraulic cylinder 1 and the second hydraulic cylinder 2.

In this embodiment, connections that connect the third solenoid valve 41, the fourth solenoid valve 42, the fifth solenoid valve 51 and the sixth solenoid valve 52 to the fluid returning port 32 are each provided with a throttle valve 8; and the second port of the first solenoid valve 61 converges to the connection pipeline between the third solenoid valve 41 and the fluid returning port 32, to implement a throttling function. The second port of the second solenoid valve 62 converges to the connection pipeline between the sixth solenoid valve 52 and the fluid returning port 32, to implement a throttling function.

In this embodiment, the first check valve 7, the second check valve 63, the third check valve 64, the fourth check valve 43, the fifth check valve 44, the sixth check valve 53, and the seventh check valve 54 are each a pilot check valve, and the first check valve 7, the second check valve 63, the third check valve 64, the fourth check valve 43, the fifth check valve 44, the sixth check valve 53, and the seventh check valve 54 are marked as C1, C2, C3, C4, C5, C6, and C7 respectively.

The first solenoid valve 61, the second solenoid valve 62, the third solenoid valve 41, the fourth solenoid valve 42, the fifth solenoid valve 51, and the sixth solenoid valve 52 are each a two-position three-way solenoid directional valve, and the first solenoid valve 61, the second solenoid valve 62, the third solenoid valve 41, the fourth solenoid valve 42, the fifth solenoid valve 51, and the sixth solenoid valve 52 are marked as DT1, DT2, DT3, DT4, DT5, and DT6 respectively.

This system has a specific working principle as follows.

1.1 the First Hydraulic Cylinder 1 Extends.

As shown in FIG. 2, pressure fluid from a pump enters a port of the fluid conveying port 31 P, the fourth solenoid valve 42 DT4 is energized, and P4 and A4 of the fourth solenoid valve 42 DT4 are opened. The pressure fluid passes through P4 and A4 of the fourth solenoid valve 42 DT4 to be input to the fifth check valve 44 C5 and forward switch on the fifth check valve 44 C5 in a single direction. The sensing connection of the fourth check valve 43 C4 senses the pressure entering the fifth check valve 44 C5, and the fourth check valve 43 C4 is actively switched on. The pressure fluid flowing out of the fifth check valve 44 C5 enters a rodless cavity of the first hydraulic cylinder 1 to push a piston of the first hydraulic cylinder 1 forward, so that the first hydraulic cylinder 1 extends. In addition, fluid in a rod cavity of the first hydraulic cylinder 1 is squeezed out, flows through the fourth check valve 43 C4 that has been actively switched on, then flows through ports of A3 and T3 of the third solenoid valve 41 DT3, and then returns to the fluid returning port 32 T.

1.2 the First Hydraulic Cylinder 1 Retracts.

As shown in FIG. 3, pressure fluid from a pump enters a port of the fluid conveying port 31 P, the third solenoid valve 41 DT3 is energized, and P3 and A3 of the third solenoid valve 41 DT3 are opened. The pressure fluid passes through P3 and A3 of the third solenoid valve 41 DT3 to be input to the fourth check valve 43 C4 and forward switch on the fourth check valve 43 C4 in a single direction. The sensing connection of the fifth check valve 44 C5 senses the pressure entering the fourth check valve 43 C4, and the fifth check valve 44 C5 is actively switched on. The pressure fluid flowing out of the fourth check valve 43 C4 enters a rod cavity of the first hydraulic cylinder 1 to push a piston of the first hydraulic cylinder 1 to retract, so that the first hydraulic cylinder 1 retracts. In addition, fluid in a rodless cavity of the first hydraulic cylinder 1 is squeezed out, flows through the fifth check valve 44 C5 that has been actively switched on, then flows through ports of A4 and T4 of the third solenoid valve 41 DT4, and then returns to the fluid returning port 32 T.

2.1 the Second Hydraulic Cylinder 2 Extends.

As shown in FIG. 4, pressure fluid from a pump enters a port of the fluid conveying port 31 P, the sixth solenoid valve 52 DT6 is energized, and P6 and A6 of the sixth solenoid valve 52 DT6 are opened. The pressure fluid passes through P6 and A6 of the sixth solenoid valve 52 DT6 to be input to the seventh check valve 54 C7 and forward switch on the seventh check valve 54 C7 in a single direction. The sensing connection of the sixth check valve 53 C6 senses the pressure entering the seventh check valve 54 C7, and the sixth check valve 53 C6 is actively switched on. The pressure fluid flowing out of the seventh check valve 54 C7 enters a rodless cavity of the second hydraulic cylinder 2 to push a piston of the second hydraulic cylinder 2 forward, so that the second hydraulic cylinder 2 extends. In addition, fluid in a rod cavity of the second hydraulic cylinder 2 is squeezed out, flows through the sixth check valve 53 C6 that has been actively switched on, then flows through ports of A5 and T5 of the fifth solenoid valve 51 DT5, and then returns to the fluid returning port 32 T.

2.2 the Second Hydraulic Cylinder 2 Retracts.

As shown in FIG. 5, pressure fluid from a pump enters a port of the fluid conveying port 31 P, the fifth solenoid valve 51 DT5 is energized, and P5 and A5 of the fifth solenoid valve 51 DT5 are opened. The pressure fluid passes through P5 and A5 of the fifth solenoid valve 51 DT5 to be input to the sixth check valve 53 C6 and forward switch on the sixth check valve 53 C6. The sensing connection of the seventh check valve 54 C7 senses the pressure entering the seventh check valve 54 C7, and the seventh check valve 54 C7 is actively switched on. The pressure fluid flowing out of the sixth check valve 53 C6 enters a rod cavity of the second hydraulic cylinder to push a piston of the second hydraulic cylinder 2 to retract, so that the second hydraulic cylinder 2 retracts. In addition, fluid in a rodless cavity of the second hydraulic cylinder 2 is squeezed out, flows through the fifth check valve 44 C5 that has been actively switched on, then flows through ports of A6 and T6 of the sixth solenoid valve 52 DT6, and then returns to the fluid returning port 32 T.

3.1. Synchronous Extension

As shown in FIG. 6, pressure fluid from a pump enters a port of the fluid conveying port 31 P, the second solenoid valve 62 DT2 is energized, and P2 and A2 of the second solenoid valve 62 DT2 are opened. The pressure fluid passes through P2 and A2 of the second solenoid valve 62 DT2 to be input to the third check valve 64 C3 and forward switch on the third check valve 64 C3. The sensing connection of the second check valve 63 C2 senses the pressure entering the third check valve 64 C3, and the second check valve 63 C2 is actively switched on.

The pressure fluid flowing out of the third check valve 64 C3 enters a rodless cavity of the second hydraulic cylinder 2 to push a piston forward, so that the second hydraulic cylinder 2 extends. In addition, fluid in a rod cavity of the second hydraulic cylinder 2 is squeezed out, and the fluid squeezed out forward switches on the first check valve 7 C1 that is hydraulically controlled; and the hydraulic fluid flowing out of the first check valve 7 C1 enters a rodless cavity of the first hydraulic cylinder 1 to push a piston of the first hydraulic cylinder 1 forward, so that the first hydraulic cylinder 1 extends. The first hydraulic cylinder 1 extends and squeezes out the fluid in the rod cavity, the fluid flows through the second check valve 63 C2 that has been actively switched on and that is hydraulically controlled, then flows through ports of A1 and T1 of the first solenoid valve 61 DT1, and returns to the fluid returning port 32 T. Because a sectional area of the rod cavity of the second hydraulic cylinder 2 is equal to a sectional area of the rodless cavity of the first hydraulic cylinder 1, a synchronous stretching function is implemented.

3.2. Synchronous Retraction

As shown in FIG. 7, pressure fluid from a pump enters a port of the fluid conveying port 31 P, the first solenoid valve 61 DT1 is energized, and P1 and A1 of the first solenoid valve 61 DT1 are opened. The pressure fluid passes through P1 and A1 of the first solenoid valve 61 DT1 to be input to the second check valve 63 C2 and forward switch on the second check valve 63 C2. The sensing connection of the first check valve 7 C1 and the sensing connection of the third check valve 64 C3 sense the pressure entering the second check valve 63 C2, and the first check valve 7 C1 and the third check valve 64 C3 are actively switched on.

The pressure fluid flowing out of the second check valve 63 C2 enters a rod cavity of the first hydraulic cylinder 1 to push a piston to retract, so that the first hydraulic cylinder 1 retracts. In addition, fluid in a rodless cavity of the first hydraulic cylinder 1 is squeezed out, and the fluid squeezed out passes through the first check valve 7; and the hydraulic fluid flowing out of the first check valve 7 C1 enters a rod cavity of the second hydraulic cylinder 2 to push a piston of the second hydraulic cylinder 2 to retract, so that the second hydraulic cylinder 2 retracts. The second hydraulic cylinder 2 retracts and squeezes out the fluid in the rodless cavity, the fluid flows through the third check valve 64 C3 that has been actively switched on and that is hydraulically controlled, then flows through ports A2 and T2 of the second solenoid valve 62 DT2, and returns to the fluid returning port 32 T.

The foregoing merely describes some implementations of the present invention. A person of ordinary skill in the art may further make several variations and improvements without departing from the creative concept of the present invention and these variations and improvements all fall within the protection scope of the present invention. Further, it has to be emphasized that the terms "first", "second" and the like are merely numerals to linguistically distinguish the elements from each other. The numerals do not imply a specific order.

The invention claimed is:

1. A hydraulic control system, comprising:

a first hydraulic cylinder;

a second hydraulic cylinder;

a fluid supply apparatus having a fluid conveying port and a fluid returning port;

a first control valve bank, wherein;

the first hydraulic cylinder is connected to the fluid conveying port and the fluid returning port by the first control valve bank, and the first control valve bank is configured to independently control the first hydraulic cylinder;

a second control valve bank, wherein;

the second hydraulic cylinder is connected to the fluid conveying port and the fluid returning port by the second control valve bank, and the second control valve bank is configured to independently control the second hydraulic cylinder;

a third control valve bank, wherein;

one port of the first hydraulic cylinder and one port of the second hydraulic cylinder are connected in series, an other port of the first hydraulic cylinder and an other port of the second hydraulic cylinder are connected to the fluid conveying port and the fluid returning port by the third control valve bank respectively, and the third control valve bank is configured to synchronously control the first hydraulic cylinder and the second hydraulic cylinder; and a first check valve, wherein;

the first check valve is disposed on a series-connection fluid path of the first hydraulic cylinder and the second hydraulic cylinder, and a sensing connection of the first check valve is connected to the third control valve bank.

2. The hydraulic control system according to claim 1, wherein the third control valve bank comprises:

a first solenoid valve; and a second solenoid valve;

wherein;

a first port of the first solenoid valve and a first port of the second solenoid valve are both connected to the fluid conveying port, a second port of the first solenoid valve and a second port of the second solenoid valve are both connected to the fluid returning port, a third port of the first solenoid valve is connected to a port of the first hydraulic cylinder, and a third port of the second solenoid valve is connected to a port of the second hydraulic cylinder.

3. The hydraulic control system according to claim 2, wherein the third control valve bank further comprises:

a second check valve; and a third check valve;

wherein;

the third port of the first solenoid valve is connected to the one port of the first hydraulic cylinder by the second check valve, the third port of the second solenoid valve is connected to the one port of the second hydraulic cylinder by the third check valve, a sensing connection of the second check valve is connected between the second solenoid valve and the third check valve, and a sensing connection of the third check valve is connected between the first solenoid valve and the second check valve.

4. The hydraulic control system according to claim 2, wherein the first control valve bank comprises:

a third solenoid valve; and a fourth solenoid valve;

wherein;

a first port of the third solenoid valve and a first port of the fourth solenoid valve are both connected to the fluid conveying port, a second port of the third solenoid valve and a second port of the fourth solenoid valve are both connected to the fluid returning port, a third port of the third solenoid valve is connected to the one port of the first hydraulic cylinder, and a third port of the fourth solenoid valve is connected to the other port of the first hydraulic cylinder.

5. The hydraulic control system according to claim 4, wherein the first control valve bank further comprises:

a fourth check valve; and a fifth check valve;

wherein;

the third port of the third solenoid valve is connected to the one port of the first hydraulic cylinder by the fourth check valve, the third port of the fourth solenoid valve is connected to the other port of the first hydraulic cylinder by the fifth check valve a sensing connection of the fourth check valve is connected between the fourth solenoid valve and the fifth check valve, and a sensing connection of the fifth check valve is connected between the third solenoid valve and the fourth check valve.

6. The hydraulic control system according to claim 4, wherein:

the third port of the first solenoid valve is connected to the one port of the first hydraulic cylinder by converging between the third solenoid valve and the first hydraulic cylinder; and the second port of the first solenoid valve is connected to the fluid returning port by converging between the third solenoid valve and the fluid returning port.

7. The hydraulic control system according to claim 1, wherein the second control valve bank comprises:

a fifth solenoid valve; and a sixth solenoid valve;

wherein;

a first port of the fifth solenoid valve and a first port of the sixth solenoid valve are both connected to the fluid conveying port, a second port of the fifth solenoid valve and a second port of the sixth solenoid valve are both connected to the fluid returning port, a third port of the fifth solenoid valve is connected to the one port of the second hydraulic cylinder, and a third port of the sixth solenoid valve is connected to the other port of the second hydraulic cylinder.

8. The hydraulic control system according to claim 7, wherein the second control valve bank further comprises:

a sixth check valve; and a seventh check valve;

wherein;

the third port of the fifth solenoid valve is connected to the one port of the second hydraulic cylinder by the sixth check valve, the third port of the sixth solenoid valve is connected to the other port of the second hydraulic cylinder by the fifth check valve;

a sensing connection of the sixth check valve is connected between the sixth solenoid valve and the seventh check valve, and a sensing connection of the seventh check valve is connected between the fifth solenoid valve and the sixth check valve.

9. The hydraulic control system according to claim 7, wherein:

the third port of the second solenoid valve is connected to the one port of the second hydraulic cylinder by converging between the sixth solenoid valve and the second hydraulic cylinder; and the second port of the second solenoid valve is connected to the fluid returning port by converging between the sixth solenoid valve and the fluid returning port.

10. The hydraulic control system according claim 1, wherein connections that connect the first control valve bank, the second control valve bank and the third control valve bank to the fluid returning port are each provided with a throttle valve.

* * * * *